US006035642A

United States Patent [19]

Peletz, Jr. et al.

[11] Patent Number: 6,035,642

[45] Date of Patent: Mar. 14, 2000

[54] REFURBISHING CONVENTIONAL POWER PLANTS FOR KALINA CYCLE OPERATION

[75] Inventors: Lawrence J. Peletz, Jr., Erie, Pa.; Michael C. Tanca, Tariffville, Conn.

[73] Assignee: Combustion Engineering, Inc., Windsor, Conn.

[21] Appl. No.: 09/231,168

[22] Filed: Jan. 13, 1999

[51] Int. Cl.[7] ..... F01K 25/06

[52] U.S. Cl. ..... 60/649; 60/651; 60/653; 60/679

[58] Field of Search ..... 60/645, 651, 653, 60/671, 649, 679; 122/406.4, 460, 1 B

[56] References Cited

U.S. PATENT DOCUMENTS

| | | | |
|---|---|---|---|
| 2,867,983 | 1/1959 | Armacost | 60/653 |
| 3,169,374 | 2/1965 | Powell et al. | 60/653 X |
| 4,208,882 | 6/1980 | Lopes et al. | 60/653 |
| 4,489,563 | 12/1984 | Kalina | 60/673 |
| 4,732,005 | 3/1988 | Kalina | 60/673 |
| 4,982,568 | 1/1991 | Kalina | 60/649 |
| 5,029,444 | 7/1991 | Kalina | 60/673 |
| 5,038,568 | 8/1991 | Gounder et al. | 60/679 |
| 5,095,708 | 3/1992 | Kalina | 60/673 |
| 5,440,882 | 8/1995 | Kalina | 60/641.2 |
| 5,442,919 | 8/1995 | Wilhelm | 60/653 X |
| 5,450,821 | 9/1995 | Kalina | 122/1 |
| 5,572,871 | 11/1996 | Kalina | 60/649 |
| 5,588,298 | 12/1996 | Kalina et al. | 60/673 |

OTHER PUBLICATIONS

Kalina Cycles for Efficient Direct Fired Application,–Alexander I. Kalina, Yakov Lerner, Richard I. Pelletier, Exergy, Inc. , Lawrence J. Peletz, Jr. ABB CE systems, Combustion engineering, Inc., –7 pgs. No Date.

Kalina Cycle Looks Good for Combined Cycle Generation–Dr. James C. Corman, Dr. Robert W. Bjorge, GE Power Systems, Dr. Alexander Kalina, Exergy, Inc., Jul., 1995–3 pgs.

Power Perspective, The Kalina Cycle–More Electricity From Each BTU of Fuel–1995–3 pgs.

A Gas Turbine–Aqua Ammonia Combined Power Cycle–Irby Hicks, The Thermosorb Company–Mar. 25, 1996–6 pgs.

Understanding the Kalina Cycle Fundamentals–H.A. Mlcak, P.E., ABB Lummus Crest–12 pgs No Date.

Direct–Fired Kalina Cycle: Overview–ABB–1994–13 pgs.

Kalina Cycle System Advancements for Direct Fired Power Generation, Michael J. Davidson, Lawrence J. Peletz, ABB Combustion Engineering,–9 pgs No Date.

Kalina Cycles and System for Direct–Fired Power Plants, A.I. Kalina, Exergy, Inc., AES–vol. 25/HTD–vol. 191–7 pgs.

*Primary Examiner*—Hoang Nguyen
*Attorney, Agent, or Firm*—Arthur E. Fournier, Jr.

[57] ABSTRACT

A method is provided which refurbishes a Rankine cycle vapor generator initially having a plurality of Rankine heaters for supporting a Rankine cycle subsystem. The method removes at least one of the Rankine heaters, and replaces the at least one removed Rankine heater with a non-Rankine heater for a Kalina cycle subsystem. The vapor generator comprises a first plurality of tubes for receiving a first working fluid, and a second plurality of tubes for receiving a second working fluid. The first plurality of tubes are directed along a first path exposed to heat from a heat source to increase the temperature of the first working fluid within the first plurality of tubes. The second plurality of tubes are directed along a second path exposed to heat from the heat source to increase the temperature of the second working fluid within the second plurality of tubes. The first plurality of tubes supply the heated first working fluid to components of a Rankine cycle subsystem and the second plurality of tubes supply the heated second working fluid to components of a Kalina cycle subsystem.

40 Claims, 9 Drawing Sheets

REFURBISHING CONVENTIONAL POWER PLANTS FOR KALINA CYCLE OPERATION

CROSS-REFERENCE TO RELATED APPLICATIONS

The present application relates to pending U.S. patent application Ser. No. 09/231,165, filed Jan. 12, 1999, for "*TECHNIQUE FOR CONTROLLING REGENERATIVE SYSTEM CONDENSATION LEVEL DUE TO CHANGING CONDITIONS IN A KALINA CYCLE POWER GENERATION SYSTEM*" (Attorney Docket No. 03156-00005); U.S. patent application Ser. No. 09/231,171, filed Jan. 12, 1999, for "*TECHNIQUE FOR BALANCING REGENERATIVE REQUIREMENTS DUE TO PRESSURE CHANGES IN A KALINA CYCLE POWER GENERATION SYSTEM*" (Attorney Docket No. 03156-0006); U.S. patent application Ser. No. 09/229,364 filed Jan. 12, 1999, for "*TECHNIQUE FOR CONTROLLING SUPERHEATED VAPOR REQUIREMENTS DUE TO VARYING CONDITIONS IN A KALINA CYCLE POWER GENERATION SYSTEM*" (Attorney Docket No. 03156-007); U.S. patent application Ser. No. 09/231,166, filed Jan. 12, 1999, for "*TECHNIQUE FOR MAINTAINING PROPER DRUM LIQUID LEVEL IN A KALINA CYCLE POWER GENERATION SYSTEM*" (Attorney Docket No. 03156-008); U.S. patent application Ser. No. 09/229,629, filed Jan. 12, 1999, for "*TECHNIQUE FOR CONTROLLING DCSS CONDENSATE LEVELS IN A KALINA CYCLE POWER GENERATION SYSTEM*" (Attorney Docket No. 0315-6009); U.S. patent application Ser. No. 09/629,230, filed Jan. 12, 1999, for "*TECHNIQUE FOR MAINTAINING PROPER FLOW IN PARALLEL HEAT EXCHANGERS IN A KALINA CYCLE POWER GENERATION SYSTEM*" (Attorney Docket No. 03156-0010); U.S. patent application Ser. No. 09/229,631, filed Jan. 12, 1999, for "TECHNIQUE FOR MAINTAINING PROPER VAPOR TEMPERATURE AT THE SUPER HEATER/REHEATER INLET IN A KALINA CYCLE POWER GENERATION SYSTEM" (Attorney Docket No. 03156-0011); U.S. patent application Ser. No. 09/231,164, filed Jan. 12, 1999, for "WASTE HEAT KALINA CYCLE POWER GENERATION SYSTEM" (Attorney Docket No. 03156-0012); U.S. patent application Ser. No. 09/229,366, filed Jan. 12, 1999, for "MATERIAL SELECTION AND CONDITIONING TO AVOID BRITTLENESS CAUSED BY NITRIDING" Attorney Docket No. 03156-0013); U.S. patent application Ser. No. 09/231,170, filed Jan. 12, 1999, for "STARTUP TECHNIQUE USING MULTIMODE OPERATION IN A KALINA CYCLE POWER GENERATION SYSTEM" (Attorney Docket No. 03156-0015); U.S. patent application Ser. No. 09/231,163, filed Jan. 12, 1999, for "TECHNIQUE FOR COOLING FURNACE WALLS IN A MULTI-COMPONENT WORKING FLUID POWER GENERATION SYSTEM" (Attorney Docket No. 03156-0016); U.S. patent application Ser. No. 09/231,362, filed Jan. 12, 1999, for "BLOWDOWN RECOVERY SYSTEM IN A KALINA CYCLE POWER GENERATION SYSTEM" (Attorney Docket No. 03156-0019); U.S. patent application Ser. No. 09/229,368, filed Jan. 12, 1999, for "REGENERATIVE SUBSYSTEM CONTROL IN A KALINA CYCLE POWER GENERATION SYSTEM" (Attorney Docket No. 03156-0020); U.S. patent application Ser. No. 09/229,363, filed Jan. 12, 1999, for "DISTILLATION AND CONDENSATION SUBSYSTEM (DCSS) CONTROL IN A KALINA CYCLE POWER GENERATION SYSTEM" (Attorney Docket No. 03156-0021); U.S. patent application Ser. No. 09/229,365, filed Jan. 12, 1999, for "VAPOR TEMPERATURE CONTROL IN A KALINA CYCLE POWER GENERATION SYSTEM" (Attorney Docket No. 03156-0022); U.S. patent application Ser. No. 09/229,367, filed Jan. 12, 1999, for "A HYBRID DUAL CYCLE VAPOR GENERATOR" (Attorney Docket No. 03156-0030); U.S. patent application Ser. No. 09/231,169, filed Jan. 12, 1999, for "FLUIDIZED BED FOR KALINA CYCLE POWER GENERATION SYSTEM" (Attorney Docket No. 03156-0032); U.S. patent application Ser. No. 09/231,167, filed Jan. 12, 1999, for "TECHNIQUE FOR RECOVERING WASTE HEAT USING A BINARY WORKING FLUID" (Attorney Docket No. 03156-0033).

FIELD OF THE INVENTION

The present invention is in the field of power generation. In particular, the present invention is related to refurbishing conventional Rankine cycle power plants for partial operation using a binary working fluid.

BACKGROUND OF THE INVENTION

In recent years, industrial and utility concerns with deregulation and operational costs have strengthened demands for increased power plant efficiency. The Rankine cycle power plant, which typically utilizes water as the working fluid, has been the mainstay for the utility and industrial power industry for the last 150 years. In a Rankine cycle power plant, heat energy is converted into electrical energy by heating a working fluid flowing through tubular walls, commonly referred to as waterwalls, to form a vapor, e.g., turning water into steam. Typically, the vapor will be superheated to form a high pressure vapor, e.g., superheated steam. The high pressure vapor is used to power a turbine/generator to generate electricity.

Conventional Rankine cycle power generation systems can be of various types, including direct-fired, fluidized bed and waste-heat type systems. In direct fired and fluidized bed type systems, combustion process heat is generated by burning fuel to heat the combustion air which in turn heats the working fluid circulating through the systems' waterwalls. In direct-fired Rankine cycle power generation systems the fuel, commonly pulverized-coal, gas or oil, is ignited in burners located in the waterwalls. In bubbling fluidized bed Rankine cycle power generation systems pulverized-coal is ignited in a bed located at the base of the boiler to generate combustion process heat. Waste-heat Rankine cycle power generation systems rely on heat generated in another process, e.g., incineration, for process heat to vaporize, and if desired superheat, the working fluid. Due to the metallurgical limitations, the highest temperature of the superheated steam does not normally exceed 1050° F. (566° C.). However, in some "aggressive" designs, this temperature can be as high as 1100° F. (593° C.).

Over the years, efficiency gains in Rankine cycle power systems have been achieved through technological improvements which have allowed working fluid temperatures and pressures to increase and exhaust gas temperatures and pressures to decrease. An important factor in the efficiency of the heat transfer is the average temperature of the working fluid during the transfer of heat from the heat source. If the temperature of the working fluid is significantly lower than the temperature of the available heat source, the efficiency of the cycle will be significantly reduced. This effect, to some extent, explains the difficulty in acheiving further gains in efficiency in conventional, Rankine cycle-based, power plants.

In view of the above, a departure from the Rankine cycle has recently been proposed. The proposed new cycle, commonly referred to as the Kalina cycle, attempts to exploit the additional degree of freedom available when using a binary fluid, more particularly an ammonia/water mixture, as the working fluid. The Kalina cycle is described in the paper entitled: "Kalina Cycle System Advancements for Direct Fired Power Generation" co-authored by Michael J. Davidson and Lawrence J. Peletz, Jr., and published by Combustion Engineering, Inc., of Windsor, Conn. Efficiency gains are obtained in the Kalina cycle plant by reducing the energy losses during the conversion of heat energy into electrical output.

A simplified conventional direct-fired Kalina cycle power generation system is illustrated in FIG. 1 of the drawings. Kalina cycle power plants are characterized by three basic system elements, the Distillation and Condensation Subsystem (DCSS) 100, the Vapor Subsystem (VSS) 110 which includes the boiler 142, superheater 144 and recuperative heat exchanger (RHE) 140, and the turbine/generator subsystem (TGSS) 130. The DCSS 100 and RHE 140 are sometimes jointly referred to as the Regenerative Subsystem (RSS) 150. The boiler 142 is formed of tubular walls 142*a* and the superheater 144 is formed of tubular walls and/or banks of fluid tubes 144*a*. A heat source 120 provides process heat 121. A portion 123 of the process heat 121 is used to vaporize the working fluid in the boiler 142. Another portion 122 of the process heat 121 is used to superheat the vaporized working fluid in the superheater 144.

During normal operation of the Kalina cycle power system of FIG. 1, the ammonia/water working fluid is fed to the boiler 142 from the RHE 140 by liquid stream FS 5 and from the DCSS 100 by liquid stream FS 7. The working fluid is vaporized, i.e., boiled, in the tubular walls 142*a* of the boiler 142. The FS rich working fluid stream 20 from the DCSS 100 is also vaporized in the heat exchanger(s) of the RHE 140.

In one implementation, the vaporized working fluid from the boiler 142 along with the vaporized working fluid FS 9 from the RHE 140, is further heated in the tubular walls/fluid tube bank 144*a* of the superheater 144. The superheated vapor from the superheater 144 is directed to and powers the TGSS 130 as FS vapor 40 so that electrical power 131 is generated to meet the load requirement. In an alternative implementation, the RHE 140 not only vaporizes but also superheats the rich stream FS 20. In such a case, the superheated vapor flow FS 9' from the RHE 140 is combined with the superheated vapor from the superheated vapor from the superheater 144 to form FS vapor flow 40 to the TGSS 130.

The expanded working fluid FS extraction 11 egresses from the TGSS 130, e.g., from a low pressure (LP) turbine (not shown) within the TGSS 130, and is directed to the DCSS 100. This expanded working fluid is, in part, condensed in the DCSS 100. Working fluid condensed in the DCSS 100, as described above, forms feed fluid FS 7 which is fed to the boiler 142. Another key feature of the DCSS 100 is the separation of the working fluid egressing from TGSS 130 into ammonia rich and ammonia lean streams for use by the VSS 110. In this regard, the DCSS 100 separates the expanded working fluid into an ammonia rich working fluid flow FS rich 20 and an ammonia lean working fluid flow FS lean 30. Waste heat 101 from the DCSS 100 is dumped to a heat sink, such as a river or pond.

The rich and lean flows FS 20, FS 30, respectively, are fed to the RHE 140. Another somewhat less expanded hot working fluid FS extraction 10 egresses from the TGSS 130, e.g., from a high pressure (HP) turbine (not shown) within the TGSS 130, and is directed to the RHE 140. Heat is transferred from the expanded working fluid FS extraction 10 and the working fluid FS lean stream 30 to the rich working fluid flow FS rich 20, to thereby vaporize the rich flow FS 20 and condense, at least in part, the expanded working fluid FS extraction 10 and FS lean working fluid flow 30, in the RHE 140. As discussed above, the vaporized rich flow FS 20 is fed to either the superheater 144, along with vaporized feed fluid from the boiler 142, or is combined with the superheated working fluid from the superheater 142 and fed directly to the TGSS 130. The condensed expanded working fluid from the RHE 140 forms part of the feed flow, i.e., flow FS 5, to the boiler 142, as has been previously described.

FIG. 2 details a portion of the RHE 140 of VSS 110 of FIG. 1. As shown, the RHE 140 receives ammonia-rich, cold high pressure stream FS rich 20 from DCSS 100. Stream FS rich 20 is heated by ammonia-lean hot low pressure stream FS 3010. The stream FS 3010 is formed by combining the somewhat lean hot low pressure FS extraction stream 10 from TGSS 130 with the lean hot low pressure stream FS 30 from DCSS 100, these flows being combined such that stream FS 30 dilutes stream FS 10 resulting in a desired concentration of ammonia in stream FS 3010.

Heat energy 125, is transferred from stream FS 3010 to stream FS rich 20. As discussed above, this causes the transformation of stream FS 20 into a high pressure vapor stream FS 9 or the high pressure superheated vapor stream FS 9', depending on the pressure and concentration of the rich working fluid stream FS 20. This also causes the working fluid stream FS 3010 to be condensed and therefore serve as a liquid feed flow FS 5 to the boiler 142.

As previously indicated, in one implementation the vapor stream FS 9 along with the vapor output from boiler 142 forms the vapor input to the superheater 144, and the superheater 144 superheats the vapor stream to form superheated vapor stream 40 which is used to power TGSS 130. Alternatively, the superheated vapor steam FS 9' along with the superheated vapor output from the superheater 144 forms the superheated vapor stream FS 40 to the TGSS 130.

FIG. 3 illustrates exemplary heat transfer curves for heat exchanges occurring in the RHE 140 of FIG. 2. A typical Kalina cycle heat exchange is represented by curves 520 and 530. As shown, the temperature of the liquid binary working fluid FS 20 represented by curve 520 increases as a function of the distance of travel of the working fluid through the heat exchanger of the RHE 140 in a substantially linear manner. That is, the temperature of the working fluid continues to increase even during boiling as the working fluid travels through the heat exchanger of the RHE 140 shown in FIG. 2. At the same time, the temperature of the liquid working fluid FS 3010 represented by curve 530 decreases as a function of the distance of travel of this working fluid through the heat exchanger of the RHE 140 in a substantially linear manner. That is, as heat energy 125 is transferred from working fluid FS 3010 to the working fluid stream FS 20 as both fluid streams flow in opposed directions through the RHE 140 heat exchanger of FIG. 2, the binary working fluid FS 3010 loses heat and the binary working fluid stream FS 20 gains heat at substantially the same rate within the Kalina cycle heat exchangers of the RHE 140.

In contrast, a typical Rankine cycle heat exchange is represented by curve 510. As shown, the temperature of the water or water/steam mixture forming the working fluid represented by curve 510 increases as a function of the distance of travel of the working fluid through a heat exchanger of the type shown in FIG. 2 only after the working fluid has been fully evaporated, i.e., vaporized. The portion 511 of curve 510 represents the temperature of the water or water/steam mixture during boiling. As indicated, the temperature of the working fluid remains substantially constant until the boiling duty has been completed. That is, in a typical Rankine cycle, the temperature of the working fluid does not increase during boiling. Rather, as indicated by portion 512 of curve 510, it is only after full vaporization, i.e., full phase transformation, that the temperature of the working fluid in a typical Rankine cycle increases beyond the boiling point temperature of the working fluid, e.g., 212 degrees Fahrenheit.

As will be noted, the temperature differential between the stream represented by curve 530, which transfers the heat energy, and the Rankine cycle stream represented by curve 510, which absorbs the heat energy, continues to increase during phase transformation. The differential becomes greatest just before complete vaporization of the working fluids. In contrast, the temperature differential between the stream represented by curve 530, and the Kalina cycle stream represented by curve 520, which absorbs the heat energy, remains relatively small, and substantially constant, during phase transformation. This further highlights the enhance efficiency of Kalina cycle heat exchange in comparison to Rankine cycle heat exchange.

As indicated above, the transformation in the RHE 140 of the liquid or mixed liquid/vapor stream FS 20 to vapor or superheated vapor stream FS 9 or 9' is possible in the Kalina cycle because, the boiling point of rich cold high pressure stream FS 20 is substantially lower than that of lean hot low pressure stream FS 3010. This allows additional boiling, and in some implementations superheating, duty to be performed in the Kalina cycle RHE 140 and hence outside the boiler 142 and/or superheater 144. Hence, in the Kalina cycle, a greater portion of the process heat 121 can be used for superheating vaporized working fluid in the superheater 144, and less process heat 121 is required for boiling duty in the boiler 142. The net result is increased efficiency of the power generation system when compared to a conventional Rankine cycle type power generation system.

FIG. 4 further depicts the TGSS 130 of FIG. 1. As illustrated, the TGSS 130 in a Kalina cycle power generation system is driven by a high pressure superheated binary fluid vapor stream FS 40. Relatively lean hot low pressure stream FS extraction 10 is directed from, for instance the exhaust of an HP turbine (not shown) within the TGSS 130 to the RHE 140 as shown in FIGS. 1 and 2. A relatively lean cooler, even lower pressure flow FS extraction 11 is directed from, for instance, the exhaust of an LP turbine (not shown) within the TGSS 130 to the DCSS 100 as shown in FIG. 1. As has been discussed to some extent above, both FS extraction flow 10 and FS extraction flow 11 retain enough heat to transfer energy to still cooler higher pressure streams in the DCSS 100 and RHE 140.

While a Kalina cycle system, as described above, shows promise in terms of greater efficiency for power plants which are designed exclusively for Kalina cycle operation, economic problems arise in scrapping existing Rankine cycle plants before the end of their planned life cycle, which could be many decades. That is, long term economic commitments and capitalization plans force utilities to continue operating conventional Rankine cycle power systems until newer systems can be phased in or until new construction is planned. In the meantime, advantage is not being taken of the potential efficiency gains made possible by the Kalina cycle system.

OBJECTS OF THE INVENTION

Accordingly, it is an object of the present invention to provide a technique for economically refurbishing existing Rankine Cycle power generation systems to improve the system efficiency.

It is a further object of the present invention to provide a technique for combining a Rankine cycle system with a non-Rankine cycle system to improve system efficiency.

It is also an object of the present invention to provide a technique for combining a Rankine cycle system with a Kalina cycle system to improve system efficiency.

It is yet another object of the present invention to provide Kalina cycle superheater and reheater wall surfaces in the main furnace section of an existing conventional Rankine cycle furnace to allow for combined Kalina cycle and Rankine cycle operation therewithin.

It is a further object of the present invention to provide a Kalina cycle evaporator in the backpass of a refurbished conventional Rankine cycle boiler to use furnace overfire to generate vapor for circulation in Kalina cycle superheater and reheater wall surfaces within the main furnace of a conventional Rankine cycle system.

It is still another object of the present invention to provide a Kalina cycle evaporative duty section in the backpass of a refurbished combined cycle Rankine cycle and Kalina cycle boiler to capture furnace overfire.

Additional objects, advantages, novel features of the present invention will become apparent to those skilled in the art from this disclosure, including the following detailed description, as well as by practice of the invention. While the invention is described below with reference to a preferred embodiment(s), it should be understood that the invention is not limited thereto. Those of ordinary skill in the art having access to the teachings herein will recognize additional implementations, modifications, and embodiments, as well as other fields of use, which are within the scope of the invention as disclosed and claimed herein and with respect to which the invention could be of significant utility.

SUMMARY OF THE INVENTION

According to the present invention, the foregoing and other objects and advantages are attained by a method of refurbishing a Rankine cycle vapor generator initially having a plurality of Rankine heaters for supporting a Rankine cycle subsystem. The method removes at least one of the Rankine heaters, and replaces the at least one removed Rankine heater with a non-Rankine heater for a non-Rankine cycle subsystem. Typically, at least one of the plurality of Rankine heaters is a Rankine superheater. Alternately, at least one of the plurality of Rankine heaters may also be a Rankine reheater. In another aspect of the present invention, the method adjusts heat output from a heat source providing heat to the vapor generator to conform to requirements of the refurbished vapor generator.

According to another aspect of the present invention, a method of refurbishing the Rankine cycle vapor generator, modifies at least one of the Rankine heaters to accept a working fluid of a non-Rankine cycle subsystem, and connects the at least one modified heater to the non-Rankine cycle subsystem.

According to yet another aspect of the present invention, a method refurbishes a Rankine cycle vapor generator to include a Kalina cycle subsystem. The method provides a Rankine cycle vapor generator having a plurality of tubes forming a heat transfer surface, and allocates a portion of the heat transfer surface to a Rankine heater, to support a Rankine cycle subsystem and a portion of the heat transfer surface to a Kalina heater to support a Kalina cycle subsystem. The Rankine heaters and Kalina heaters may be superheaters or reheaters.

In another aspect of the present invention, the allocating step further includes forming the Kalina cycle heater by modifying the plurality of tubes.

In yet another aspect of the present invention, the method replaces a portion of the plurality of tubes forming the heat transfer surface allocated to the Rankine heater with replacement tubes for a Kalina heater.

In yet another aspect of the present invention, the method adds a first header for the Kalina heater and a second header for the Rankine heater wherein the first header is distinct from the second header.

In still another aspect of the present invention, the method adjusts heat output from a heat source providing heat to the vapor generator to conform to requirements of the refurbished vapor generator.

According to the present invention, a vapor generating system comprises a first plurality of tubes for receiving a first working fluid, and a second plurality of tubes for receiving a second working fluid. The first plurality of tubes are directed along a first path exposed to heat from a heat source to increase the temperature of the first working fluid within the first plurality of tubes. The second plurality of tubes are directed along a second path exposed to heat from the heat source to increase the temperature of the second working fluid within the second plurality of tubes. The first plurality of tubes supply the heated first working fluid to components of a Rankine cycle subsystem and the second plurality of tubes supply the heated second working fluid to components of a non-Rankine cycle subsystem.

Preferably, the non-Rankine cycle subsystem is a Kalina cycle subsystem, and the second working fluid is a binary working fluid. Advantageously, the second working fluid is a mixture of ammonia and water.

In another aspect of the present invention, the first working fluid is typically water, but may also be another component, such as water, or a mixture, such as ammonia and water.

Typically, the first and second plurality of tubes are each formed of an alloy steel.

In another aspect of the present invention, the first plurality of tubes form one of a superheater and a reheater and the second plurality of tubes form one of a non-Rankine cycle superheater and a non-Rankine cycle reheater. The second plurality of tubes occupy space previously occupied by a third plurality of tubes which previously formed a portion of one of an original Rankine cycle superheater and a Rankine cycle reheater.

In yet another aspect of the present invention, a third plurality of tubes forms an evaporator. The second plurality of tubes forms a superheater. The evaporator is configured to receive the second working fluid, evaporate the received second working fluid, and supply the evaporated second working fluid to the superheater.

In still another aspect of the present invention, the vapor generator further includes a third plurality of tubes forming an evaporator and the vapor generator further includes a backpass. The evaporator is placed in the backpass. The backpass has sufficient space to include the evaporator.

In yet another aspect of the present invention, a recuperative generator is configured to heat the second working fluid to a superheated temperature. The second working fluid is heated by an exhaust fluid stream received at the output of a plurality of non-Rankine cycle turbines. The second working fluid at the superheated temperature is received by the second plurality of tubes.

In accordance with another feature of the present invention, a system for generating power, comprises a heat source producing heat, and a vapor generator. The vapor generator includes a first superheater configured to receive a first working fluid for a Rankine cycle subsystem and to direct the first working fluid along a path to superheat the first working fluid with heat from the heat source. The vapor generator additionally includes a second superheater configured to receive a second working fluid for a non-Rankine cycle subsystem, and to direct the second working fluid along a path to superheat the second working fluid with heat from the heat source. Preferably, the non-Rankine cycle subsystem is a Kalina cycle subsystem, and the second working fluid is a binary working fluid, preferably a mixture of ammonia and water.

Another feature of the present invention comprises a Rankine turbine, coupled to the vapor generator, receiving the superheated first working fluid from the first superheater, and a non-Rankine turbine, also coupled to the vapor generator, receiving the second working fluid from the second superheater.

In still another feature of the present invention, the non-Rankine turbine extracts heat from the second working fluid to perform mechanical work and outputs an exhausted second working fluid. Furthermore, a distillation/condensation subsystem receives the exhausted second working fluid from the non-Rankine turbine and condenses the exhausted second working fluid, and splits the exhausted second working fluid into a rich fluid stream and a lean fluid stream.

In yet another feature of the present invention, the lean fluid stream is a first mixture of ammonia and water. The ammonia of the first mixture is a predetermined percentage of the water. The rich fluid stream is a second mixture of ammonia and water. The percentage of ammonia in the second mixture is greater than the predetermined percentage of the first mixture.

In still another feature of the present invention, a recuperative generator receives the lean fluid stream and the rich fluid stream from the distillation/condensation subsystem.

According to yet another feature of the present invention, the recuperative generator receives a portion of the exhausted second working fluid from the non-Rankine turbine, and in a heat exchanger heats the rich stream to a superheated temperature. The second working fluid is heated by the exhausted second working fluid, the second working fluid at the superheated temperature being received by the non-Rankine superheater.

Preferably, the heat source of the vapor generator is direct-fired powered. Advantageously, the heat source of the vapor generator may be a circulating fluidized bed. The heat source of the vapor generator may also be a waste heat generator.

In another feature of the present invention, the vapor generator is initially designed to receive a predetermined heat from the heat source to operate a Rankine cycle system. The heat source is also designed to be capable of transferring heat at an extra margin above the predetermined heat, so that the Rankine cycle subsystem and the non-Rankine cycle subsystem receive the heat from the heat source at the predetermined heat plus the extra margin. Typically, the extra margin is about 6 percent.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF THE INVENTION

Figure 1:
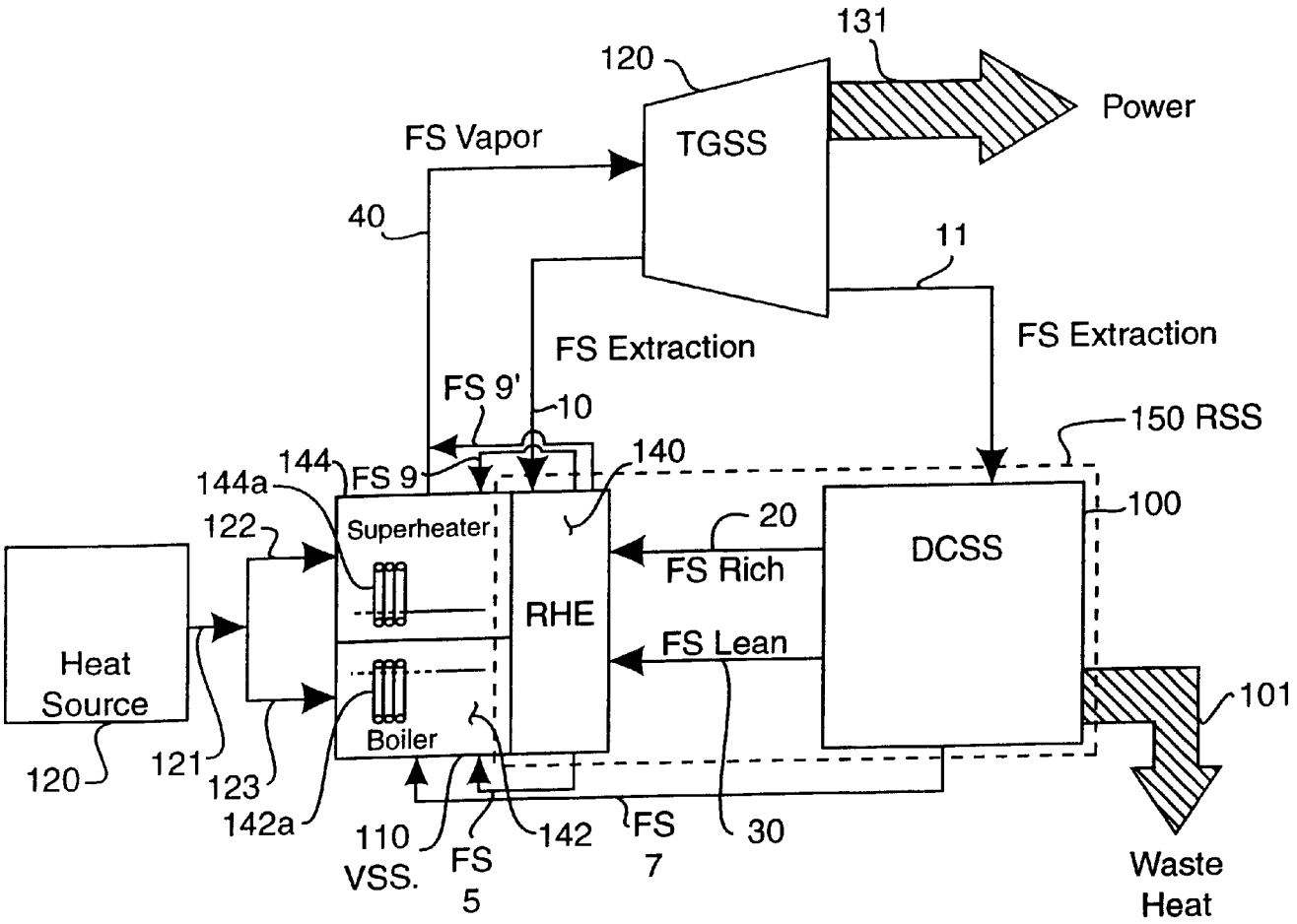
FIG. 1 PRIOR ART
FIG. 1 is a simplified block diagram of a prior art Kalina cycle system.
Figure 2:
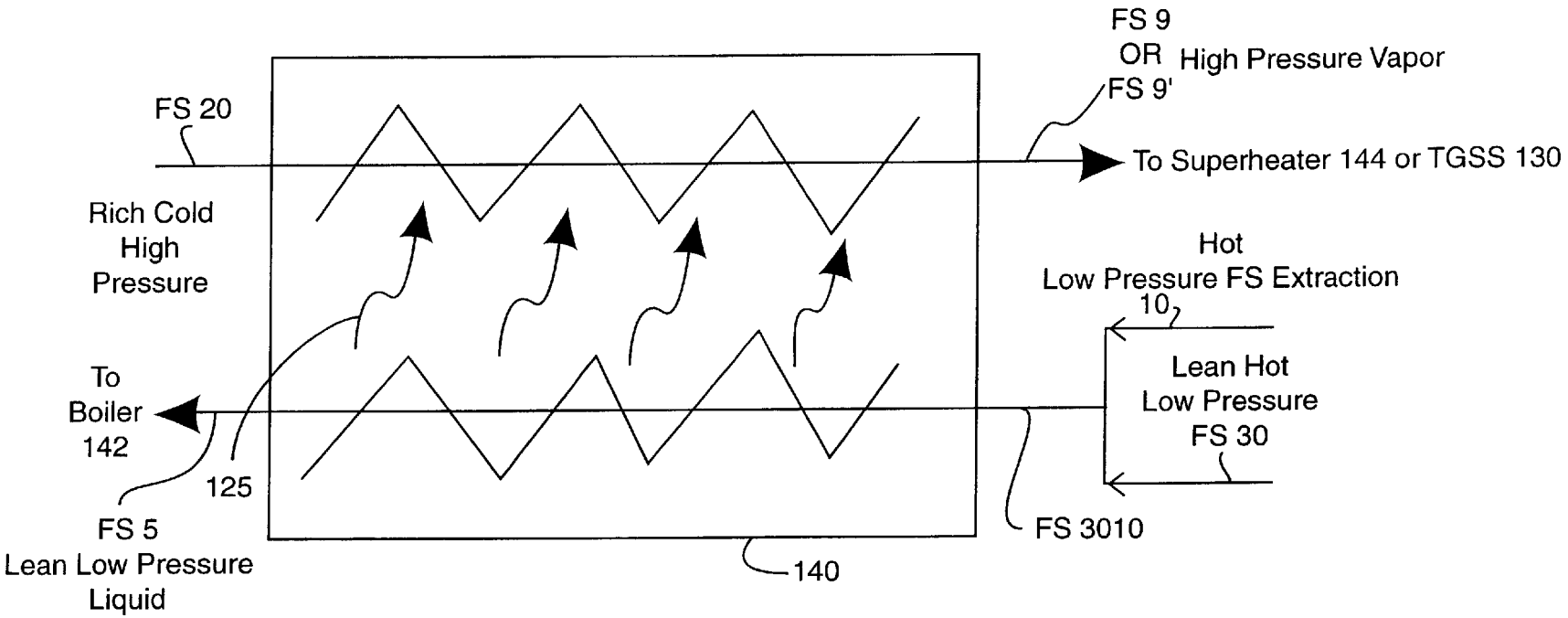
FIG. 2 (PRIOR ART)
FIG. 2 is a diagram illustrating basic heat exchange between two flow streams in a conventional Kalina cycle system.
Figure 3:
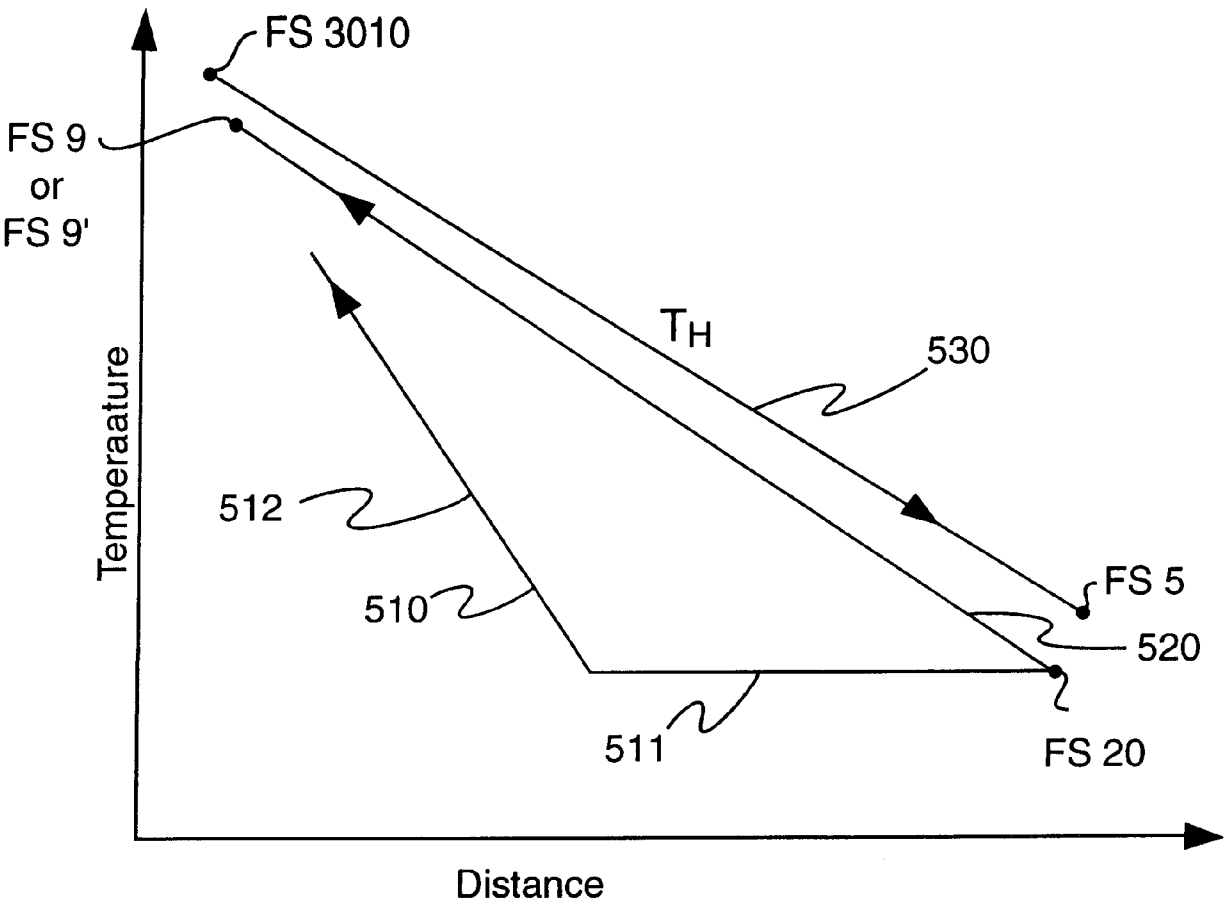
FIG. 3 (PRIOR ART)
FIG. 3 is a graph illustrating the fundamental temperature vs. entropy relationships in a conventional Kalina cycle.
Figure 4:
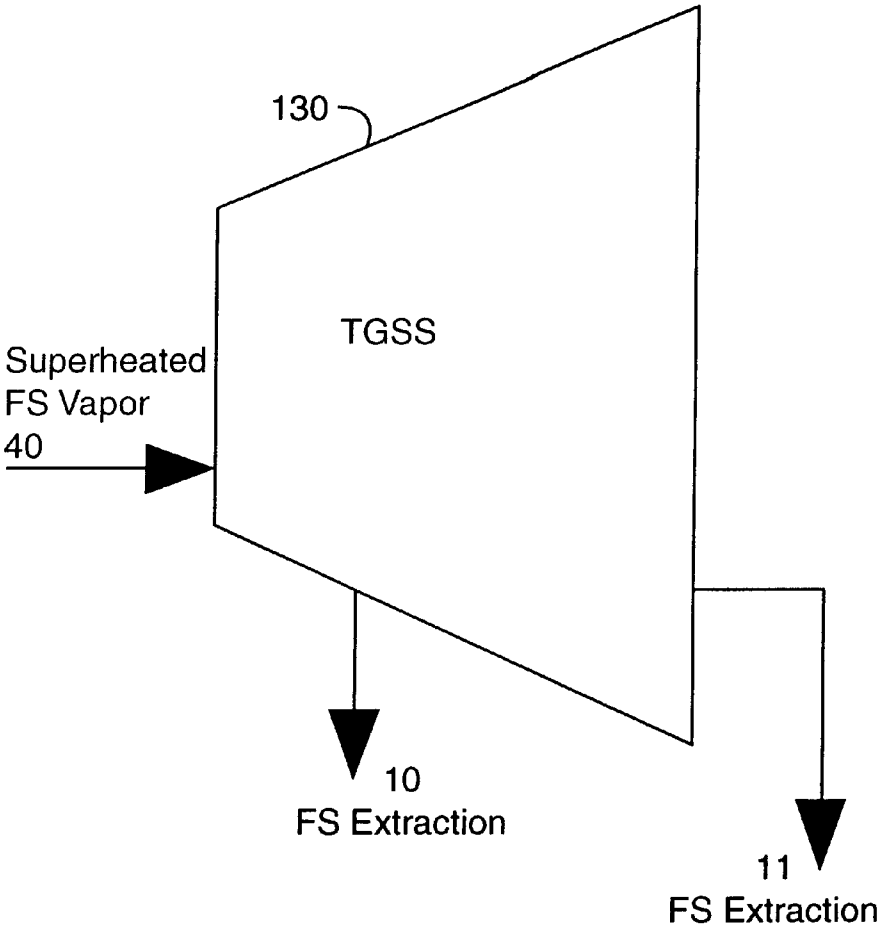
FIG. 4 PRIOR ART
FIG. 4 is a diagram illustrating high pressure vapor, low pressure vapor, and condensate extraction for a HP turbine/generator in a conventional Kalina cycle system.
Figure 5:
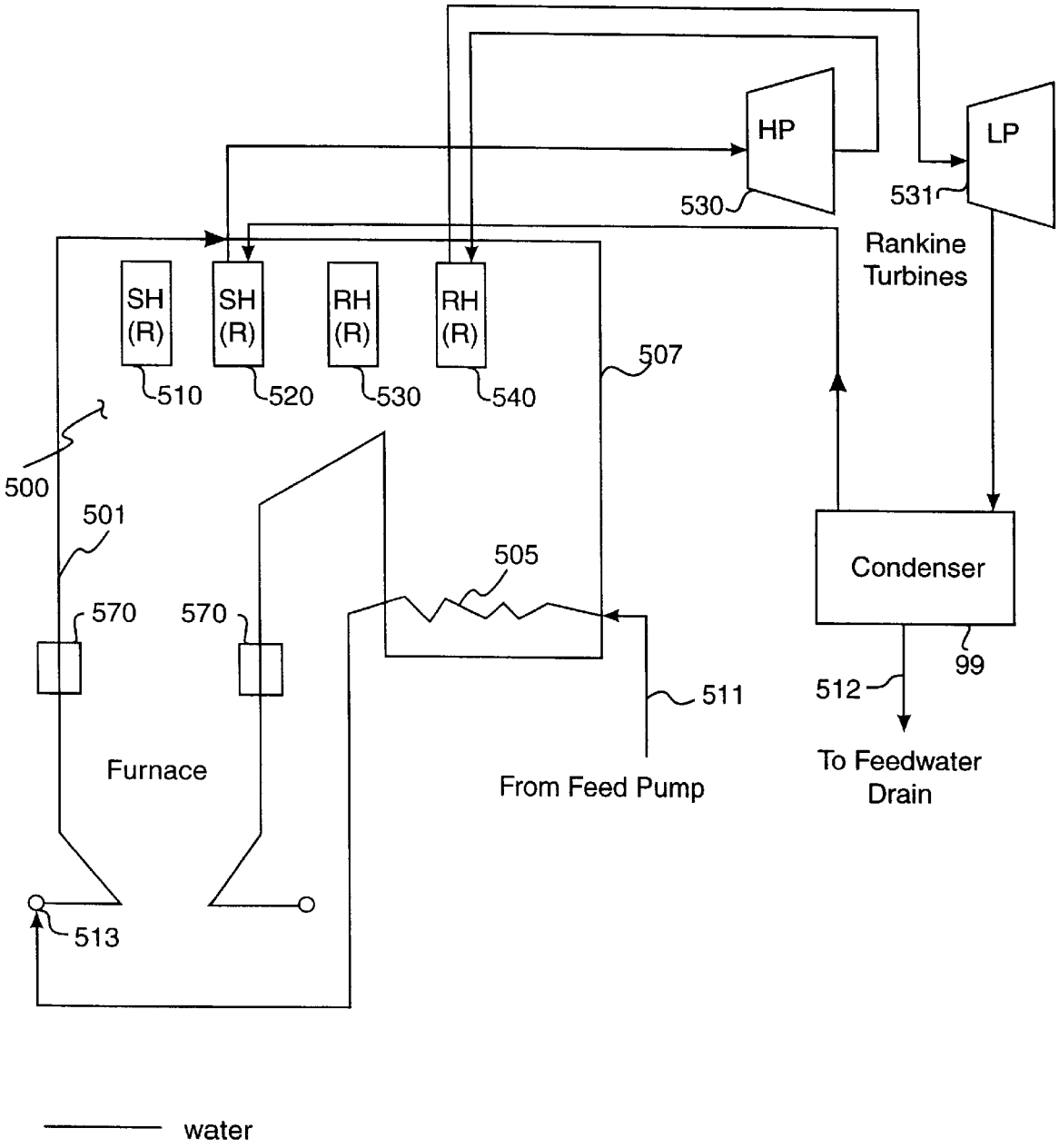
FIG. 5 PRIOR ART
FIG. 5 is a diagram illustrating a conventional Rankine cycle power generation system.

FIG. 5 shows a Rankine cycle system including a furnace 500, a plurality of turbines, including a high pressure turbine (HP) 530 and a low pressure turbine (LP) 531, and a condenser 99.

Furnace 500 has a backpass 507 for collecting heat energy from combustion gases generated by burners 570. The walls of furnace 500 include a plurality of tubes surrounded by firewall material which form a boiler 501. The burners 570 provide heat energy for the furnace 500.

In an embodiment of the present invention, the Rankine cycle proceeds as follows. Water from feed pump 511 enters furnace 500 and travels through preheater 505 where the water is preheated by the combustion gases flowing through backpass 507. The preheated water proceeds to the water enter inlet 513 of the furnace walls. A portion of the water in the furnace walls 501 boils and then enters a vessel that allows the vapor and water to separate. The water is returned to the furnace wall inlet 513. The vapor then enters superheater 520 to receive additional heat energy to superheat the vapor to the desired temperature. The superheated vapor then moves to high pressure turbine 530 which extracts heat from the superheated vapor to perform mechanical work. The expanded vapor provided as an output from the high pressure turbine 530 returns to the furnace to be reheated by reheater 540. The reheated vapor is then transported to low pressure turbine 531 which extracts heat from the superheated vapor to perform additional mechanical work. Turbine 531 then provides the expanded vapor as an output to condenser 99. Condenser 99 condenses the vapor from the output of turbine 531 back to a liquid, i.e., water. The water is transported to the feedwater drain 512 to be returned to the feed input 511, thus completing the Rankine cycle.

Figure 6:
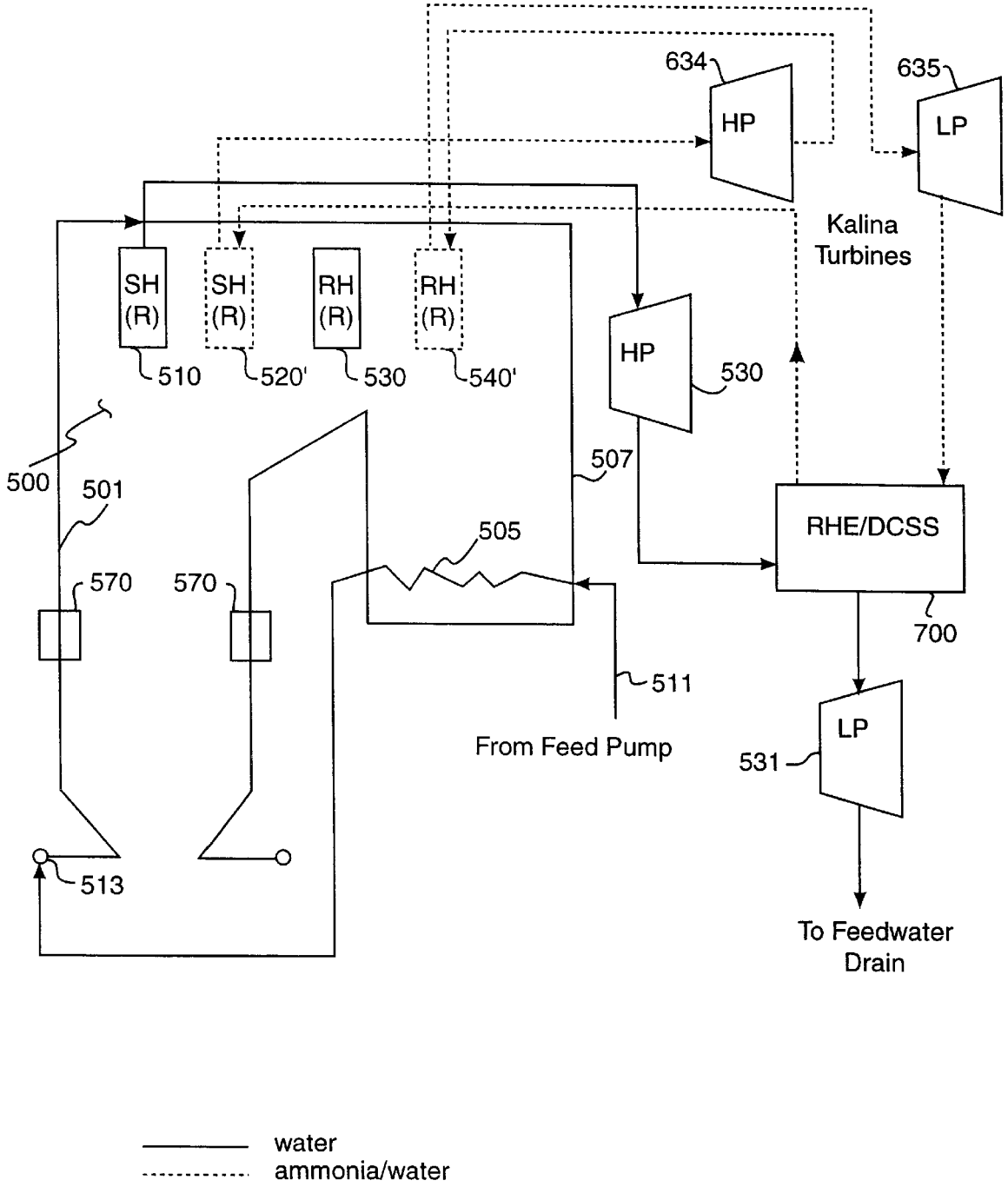
FIG. 6 is a diagram illustrating a conventional Rankine cycle power generation system refurbished for partial Kalina cycle operation and including a superheater and a reheater.

FIG. 6 illustrates an embodiment of the present invention where the conventional Rankine cycle power generation system shown in FIG. 5 is refurbished to include a Kalina cycle subsystem along with the existing Rankine cycle system to generate power. The existing Rankine cycle boiler wall surface is refurbished with a Kalina cycle superheater 520' and reheater 540', respectively, replacing superheater 520 and reheater 540. Heat captured by the Kalina cycle heaters is used more efficiently in the Kalina cycle, thereby increasing the overall plant efficiency. To reduce the cost of retrofitting and to increase the plant efficiency, the current furnace 500 remains in operation, with minor modifications.

Kalina cycle high pressure turbine 634 and low pressure turbine 635 are added to the Kalina cycle subsystem. Other embodiments of FIG. 6 are possible by varying components of the subsystems. For example, there may be one or more turbines, including intermediate pressure turbines, and one or more heaters and reheaters.

The surfaces of Rankine superheater 510 and Rankine reheater 530 may be modified to account for a shift in some of the duty from the Rankine cycle to the Kalina cycle.

Surfacing of furnace 500 may be reallocated without significant changes to heat transfer surfaces themselves. Existing superheater surfaces may be allocated between existing Rankine superheater 510 and Kalina superheater 520', and between existing Rankine reheater 530 and Kalina reheater 540'. Allocation may be accomplished by reworking external header connections to furnace tubes to re-connect specific sections of heat transfer surfaces to specific kinds of duty for which the heat transfer surface is appropriate, e.g., superheat duty, reheat duty, or the like.

The heat supply of furnace 500, in addition to providing heat for conventional Rankine system duties, is used to perform superheating 520' and reheating 540' duties upon the Kalina streams. By maintaining existing steam cycle operations, all existing steam duties (sootblowing, turbine sealing, building heating, etc.) may still be met without the use of an auxiliary steam source. To account for steam duties, firing rates for furnace 500 may be slightly increased to accommodate the additional Kalina cycle duty while still allowing excess heat margins to be recaptured using Kalina efficiency gains. Additional costs associated with advanced materials for conventional Rankine sections may be avoided all together in these sections.

By using existing heat transfer surfaces of furnace 500 for superheat and reheat duty, no new configuration for the Kalina cycle is required in these sections. Furnace 500 therefore remains a Rankine based unit producing steam for power, while a portion of the duty used in the Rankine cycle is changed to duty in the more efficient Kalina cycle using superheater 520' and reheater 540'. Changes to heat sources are possible without affecting the character of the Kalina cycle refurbishments. A fluidized bed system (not shown), for example, may easily be substituted in place of a pulverized coal combustor system to provide an alternative source of combustion heat.

Figure 8:
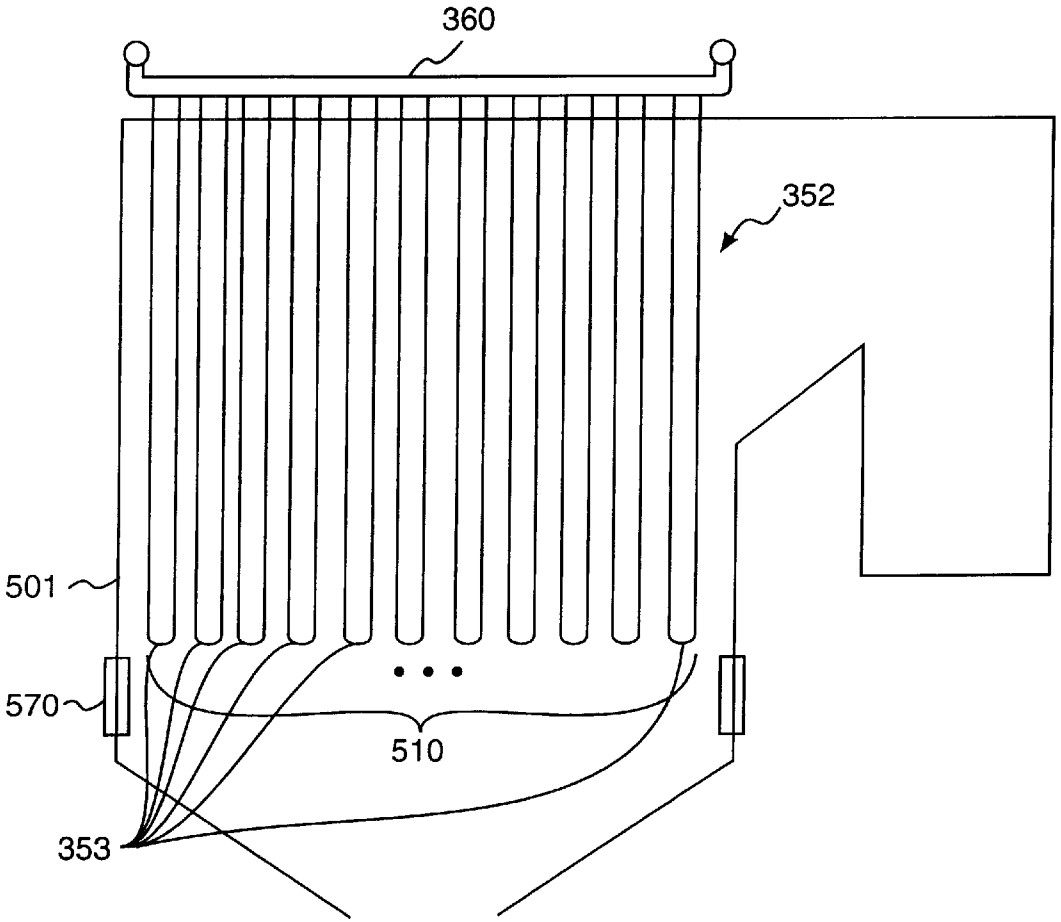
FIG. 8 is a block diagram further illustrating a tube wall section of a conventional Rankine cycle power generation system.
Figure 9:
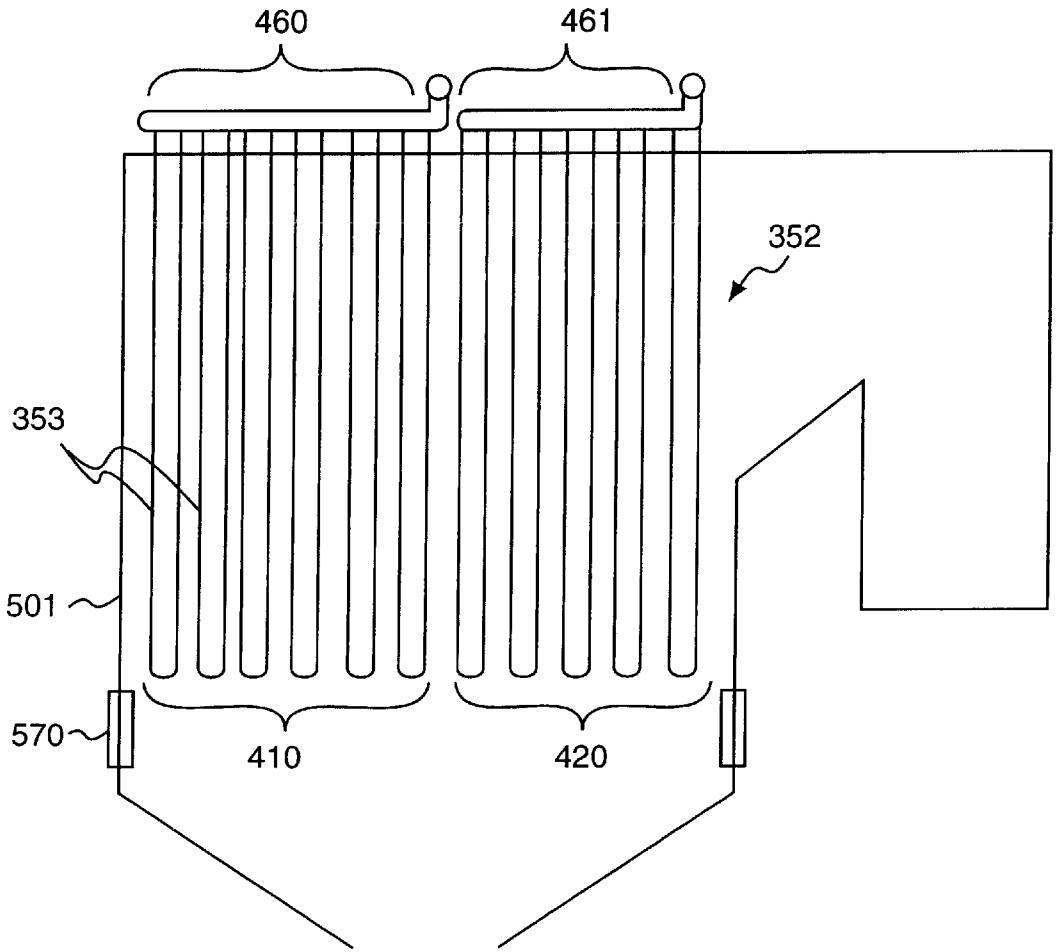
FIG. 9 is a block diagram further illustrating refurbishment of the tube wall section of FIG. 8 to include a Rankine cycle heater with a Kalina cycle heater.

FIG. 8 and FIG. 9 illustrate one possible technique for refurbishing reheaters and superheaters. FIG. 8 illustrates a typical Rankine superheater 510, or alternately a Rankine reheater 530, of a furnace 500 in a Rankine cycle subsystem. Furnace 500 is provided with pulverized coal burners 570 to provide heat for a typical furnace wall superheater or reheater section 352 of the typical superheater 510. It is to be noted that the furnace tubes 353 may be of a typical high heat steel construction, preferably austenitic stainless steel and are coupled through header 360 to the vapor inlet and outlet. While illustrated in FIG. 8 as being a vertically arranged series of furnace tubes, furnace tubes 353 may be of any orientation provided they share a common header 360.

An existing Rankine cycle pulverized coal furnace as illustrated in FIG. 8 of the drawings may be refurbished for Kalina cycle operation as illustrated in FIG. 9 of the drawings. Rankine cycle section 410 and Kalina cycle section 420 each comprise a portion of furnace tubes 353 to carry out duty whether superheat or reheat duty. While Rankine cycle section 410 and Kalina cycle section 420 are shown comprising the full extent of the volume of furnace 500, more sections may be added as described in further detail hereinafter.

The key to refurbishing an existing Rankine cycle furnace such as furnace 500 is allocating the existing furnace tubes 353, by replacing header 360 with headers 460, 461 and using header 460 for Rankine cycle allocation and header 461 for Kalina cycle allocation. In this manner any number of permutations of superheat, reheat, Rankine, and Kalina cycle duty may be allocated simply by removing and reconfiguring headers. Furnace tubes 353 are constructed of inherently corrosion resistant materials, and thus are suitable for use in either the Rankine or Kalina cycle subsystems. Thus, furnace tubes 353 remain in place.

As shown in FIG. 6, in the present invention, in addition to the condenser 99, a distillation and condensation subsystem (DCSS) and a recuperative heat exchanger (RHE) 700 has been incorporated. An embodiment of the present invention shown in FIG. 6 includes a Rankine cycle subsystem, designated by the solid lines, integrated with a Kalina cycle subsystem, designated by the dotted lines. In the Kalina cycle subsystem, an ammonia/water fluid stream heated by the recuperative generator (RHE) is vaporized and sent to the Kalina superheater 520'. The superheated vapor is then heated to a high temperature and sent from superheater 520' to the high pressure Kalina turbine 634. The vapor at the output of turbine 634 is then sent to reheater 540' to absorb additional heat energy and thereafter flows on to low pressure turbine 635. The output of low pressure turbine 635 is sent to the DCSS which condenses the output back to a liquid. In addition, the heat energy of the exhausted output of the low pressure turbine 635 is used in the recuperative generator (RHE) to vaporize the fluid stream which goes to the superheater 520'. This completes the Kalina cycle. The Rankine cycle is similar to that described in FIG. 5.

Figure 7:
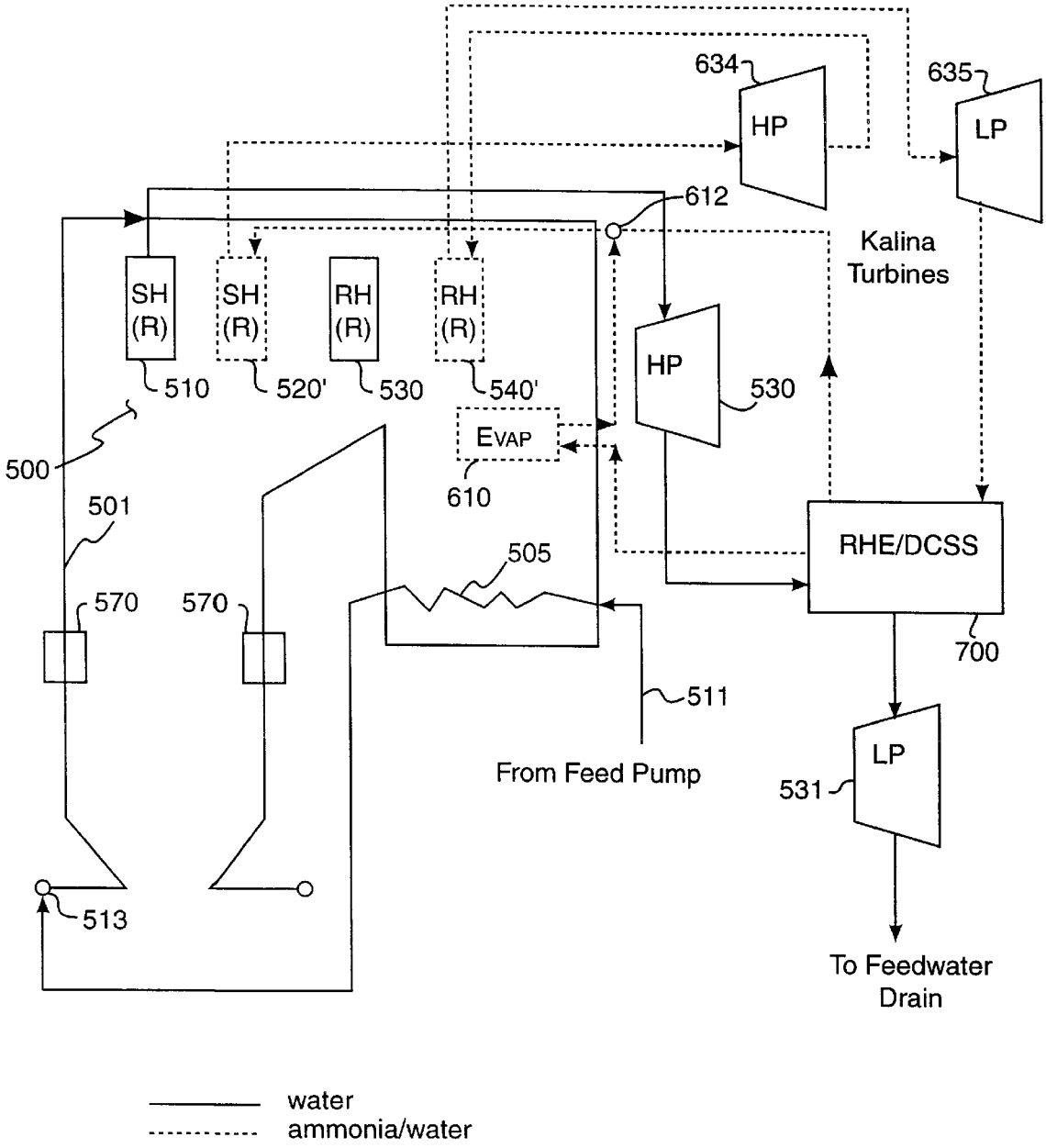
FIG. 7 is a diagram illustrating a conventional Rankine cycle power generation system refurbished for partial Kalina cycle operation and including an evaporator in the furnace backpass section.

FIG. 7 illustrates the refurbished existing Rankine cycle plant of FIG. 6, adapted with backpass evaporator 610 added in the final backpass stage to recover heat from flue gases for performing combustion air or feed fluid preheating. The vaporized fluid output from evaporator 610 is combined with the vaporized fluid output of the RHE at combiner 612 and the combined fluid provided as an input to the superheater 520'.

Furnace 500 may be a conventional pulverized coal fired system using burners 570, or may be replaced with a circulating fluidized bed (CFB) system as previously suggested. In sites where power output cannot be increased, load to an existing steam turbine cycle may be reduced while making up the remaining load in a parallel Kalina cycle turbine generator system 634, 635. Where plant power output may be increased, load may be maintained in the existing steam cycle and plant output may be increased overall by refurbishing with Kalina cycle superheater 520' and reheater 540' stages.

The key to refurbishing furnace 500 to add a Kalina cycle subsystem to the existing Rankine cycle subsystem is to allocate the Rankine and Kalina cycles within the boiler heat transfer surfaces. Partial boiler heat transfer surfacing would be solely based on the Kalina cycle and the remaining heat transfer surfacing would be solely designed to support the Rankine cycle. Since furnace 500 offers many types of heat transfer surfacing options, refurbishing to a combined Rankine/Kalina cycle can be accomplished by associating the required duties of each cycle to specific boiler heat transfer surfaces. As an example, the Rankine cycle duty could be performed with fluid bed heat exchangers and backpass convection surfacing while the Kalina cycle could be performed with furnace walls, internal heat transfer surface panels and backpass evaporation 610 surfaces. Any number of combinations and permutations can be used.

The use of the Kalina cycle with CFB furnace 500 can theoretically increase the plant efficiency from 34 to 36%, with a 2400 psi, reheat cycle to a potential 40 to 43% with Kalina, depending on the amount of Kalina/(Kalina+Rankine) cycles. CFB furnace 500 offers many advantages for the use of the Kalina cycle including: 1) a flexible arrangement using furnace wall surfaces, internal furnace pendant surfaces, fluid bed heat exchangers with SH, RH and evaporative duties, conventional and split backpasses; 2) low heat fluxes and temperatures within CFB furnace 500 allowing the use of simpler, less costly metallurgy; 3) external fluidized bed heat exchangers which may be tailored to performing duties external to the furnace.

The present invention is not to be limited in scope by the specific embodiments described herein. Indeed, various modifications of the present invention, in addition to those described herein, will be apparent to those of skill in the art from the foregoing description and accompanying drawings. Thus, such modifications are intended to fall within the scope of the appended claims.

What is claimed is:

1. A method of refurbishing a Rankine cycle vapor generator, the vapor generator including a plurality of Rankine heaters for supporting a Rankine cycle subsystem, comprising the steps of:

removing at least one of the plurality of Rankine heaters; and replacing the at least one removed Rankine heater with a non-Rankine heater for a non-Rankine cycle subsystem.

2. The method of claim 1, wherein at least one of the plurality of Rankine heaters is a Rankine superheater.

3. The method of claim 1, wherein at least one of the plurality of Rankine heaters is a Rankine reheater.

4. The method of claim 1, further comprising the step of:

adjusting heat output from a heat source providing heat to the vapor generator to conform to requirements of the refurbished vapor generator.

5. A method of refurbishing a Rankine cycle vapor generator, the vapor generator including a plurality of Rankine heaters for supporting a Rankine cycle subsystem, comprising the steps of:

modifying at least one of the plurality of Rankine heaters to accept a working fluid of a non-Rankine cycle subsystem; and connecting the at least one modified heater to the non-Rankine cycle subsystem.

6. The method of claim 5, wherein one of the plurality of Rankine heaters is a Rankine superheater.

7. The method of claim 5, wherein one of the plurality of Rankine heaters is a Rankine reheater.

8. A method of refurbishing a Rankine cycle vapor generator to include a Kalina cycle subsystem, comprising the steps of:

providing a Rankine cycle vapor generator having a plurality of tubes forming a heat transfer surface; and allocating a portion of the heat transfer surface to a Rankine heater to support a Rankine cycle subsystem and a portion of the heat transfer surface to a Kalina heater to support a Kalina cycle subsystem.

9. The method of claim 8, wherein:

the Rankine heater is one of superheaters and reheaters.

10. The method of claim 8, wherein:

the Kalina heater is one of superheaters and reheaters.

11. The method of claim 8, wherein:

the allocating step further includes forming the Kalina cycle heater by modifying the plurality of tubes.

12. The method of claim 8, further comprising the step of:

replacing a portion of the plurality of tubes forming the heat transfer surface allocated to the Kalina heater with replacement tubes for a Kalina heater.

13. The method of claim 8, further comprising the step of:

adding a first header for the Kalina heater and a second header for the Rankine heater wherein the first header is distinct from the second header.

14. The method of claim 8, further comprising the step of:

adjusting heat output from a heat source providing heat to the vapor generator to conform to requirements of the refurbished vapor generator.

15. A vapor generating system, comprising:

a first plurality of tubes for receiving a first working fluid; and a second plurality of tubes for receiving a second working fluid;

wherein the first tubes are directed along a first path exposed to heat from a heat source to increase the temperature of the first working fluid within the first plurality of tubes and the second plurality of tubes are directed along a second path exposed to heat from the heat source to increase the temperature of the second working fluid within the second plurality of tubes;

wherein the first plurality of tubes supply the heated first working fluid to components of a Rankine cycle subsystem and the second plurality of tubes supply the heated second working fluid to components of a non-Rankine cycle subsystem.

16. The vapor generating system of claim 15, wherein the non-Rankine cycle subsystem is a Kalina cycle subsystem, and wherein the second working fluid is a binary working fluid.

17. The vapor generating system of claim 15, wherein the non-Rankine cycle subsystem is a Kalina cycle subsystem, and wherein the second working fluid is a mixture of ammonia and water.

18. The vapor generating system of claim 15, wherein the first working fluid is a non-binary working fluid for the Rankine cycle subsystem.

19. The vapor generating system of claim 15, wherein the first working fluid is a binary working fluid for the Rankine cycle subsystem.

20. The vapor generating of claim 15, wherein:

the first and second plurality of tubes are formed of an alloy steel.

21. The vapor generating of claim 15, wherein:

the first plurality of tubes form one of a superheater and a reheater for the Rankine cycle subsystem.

22. The vapor generating of claim 15, wherein:

the second plurality of tubes form one of a superheater and a reheater for the non-Rankine cycle subsystem.

23. The vapor generating system of claim 15, wherein the first plurality of tubes form one of a superheater and a reheater and the second plurality of tubes form one of a non-Rankine cycle superheater and a non-Rankine cycle reheater, the second plurality of tubes occupying space previously occupied by a third plurality of tubes which previously formed a portion of one of an original Rankine cycle superheater and a Rankine cycle reheater.

24. The vapor generating system of claim 15, further comprising:

a third plurality of tubes forming an evaporator, wherein the second plurality of tubes forms a superheater, wherein the evaporator is configured to receive the second working fluid, evaporate the received second working fluid, and supply the evaporated second working fluid to the superheater.

25. The vapor generating system of claim 15, further comprising:

a third plurality of tubes forming an evaporator; and a backpass, wherein the evaporator is placed in the backpass, the backpass having sufficient space to include the evaporator.

26. The vapor generating system of claim 15, further comprising:

a recuperative generator configured to heat the second working fluid to a superheated temperature, the second working fluid being heated by an exhaust fluid stream received at the output of a plurality of non-Rankine cycle turbines, the second working fluid at the superheated temperature being received by the second plurality of tubes.

27. A system for generating power, comprising:

a heat source producing heat; and a vapor generator, including:

a first superheater configured to receive a first working fluid for a Rankine cycle subsystem and to direct the first working fluid along a path to superheat the first working fluid with heat from the heat source; and a second superheater configured to receive a second working fluid for a non-Rankine cycle subsystem, and to direct the second working fluid along a path to superheat the second working fluid with heat from the heat source.

28. The system for generating power of claim 27, wherein the non-Rankine cycle subsystem is a Kalina cycle subsystem, and wherein the second working fluid is a binary working fluid.

29. The system for generating power of claim 27, wherein the first working fluid is a non-binary working fluid for the Rankine cycle subsystem.

30. The system for generating power of claim 27, wherein the first working fluid is a binary working fluid for the Rankine cycle subsystem.

31. The system for generating power of claim 27, further comprising:

a Rankine cycle turbine, coupled to the vapor generator, receiving the superheated first working fluid from the first superheater; and a non-Rankine cycle turbine, coupled to the vapor generator, receiving the second working fluid from the second superheater.

32. The system for generating power of claim 31, wherein the non-Rankine cycle turbine extracts heat from the second working fluid to perform mechanical work and outputs an exhausted second working fluid, and further comprising:

a distillation/condensation subsystem receiving the exhausted second working fluid from the non-Rankine cycle turbine and condensing the exhausted second working fluid, and splitting the exhausted second working fluid into a rich fluid stream and a lean fluid stream.

33. The system for generating power of claim 32, wherein the lean fluid stream is a first mixture of ammonia and water, the ammonia of the first mixture being a predetermined percentage of the water, and wherein the rich fluid stream is a second mixture of ammonia and water, the percentage of ammonia in the second mixture being greater than the predetermined percentage of the first mixture.

34. The system for generating power of claim 33, further comprising:

a recuperative generator receiving the lean fluid stream and the rich fluid stream from the distillation/condensation subsystem.

35. The system for generating power of claim 34, wherein:

the recuperative generator receives a portion of the exhausted second working fluid from the non-Rankine cycle turbine, and in a heat exchanger heats the rich stream to a superheated temperature, the second working fluid being heated by the exhausted second working fluid, the second working fluid at the superheated temperature being received by the non-Rankine superheater.

36. The system for generating power of claim 27, wherein the heat source of the vapor generator is direct-fired powered.

37. The system for generating power of claim 27, wherein the heat source of the vapor generator is a circulating fluidized bed.

38. The system for generating power of claim 27, wherein the heat source of the vapor generator is a waste heat generator.

39. The system for generating power of claim 27, wherein the vapor generator is initially designed to receive a predetermined heat from the heat source to operate a Rankine cycle system, and the heat source is also designed to be capable of transferring heat at an extra margin above the predetermined heat, so that the Rankine cycle subsystem and the non-Rankine cycle subsystem receive the heat from the heat source at the predetermined heat plus the extra margin.

40. The system for generating power of claim 39, wherein the extra margin is about 6 percent.

* * * * *